United States Patent [19]

Denton et al.

[11] 4,079,733

[45] Mar. 21, 1978

[54] PERCUSSION VIBRATOR DEVICE FOR TREATMENT OF PATIENTS TO ASSIST EXPECTORATION OF RETAINED SECRETIONS

[75] Inventors: Robert C. Denton, Livermore; Marvin H. Primack, Stockton, both of Calif.

[73] Assignee: Hamburg Group, Stockton, Calif.

[21] Appl. No.: 692,191

[22] Filed: Jun. 2, 1976

[51] Int. Cl.[2] ..... A61H 23/00

[52] U.S. Cl. ..... 128/55

[58] Field of Search ..... 128/49–55, 128/24.2

[56] References Cited

U.S. PATENT DOCUMENTS

| | | | |
|---|---|---|---|
| 738,357 | 9/1903 | Reade et al. | 128/51 |
| 794,003 | 7/1905 | Gates | 128/51 |
| 934,662 | 9/1909 | Faison | 128/52 |
| 2,138,815 | 12/1938 | Eberly | 128/52 |
| 3,601,122 | 8/1971 | Guertin | 128/55 |
| 3,955,563 | 5/1976 | Malone | 128/55 |

*Primary Examiner*—Lawrence W. Trapp

*Attorney, Agent, or Firm*—Stevens, Davis, Miller & Mosher

[57] ABSTRACT

A percussion vibrator apparatus for treating patients having obstructive pulmonary disorders has a reciprocating member provided with a pad of foam rubber or the like having a 25% compression deflection of from about 5 psi to about 12 psi and a 60% compression deflection of from about 40 psi to about 80 psi. Reciprocating motion is imparted to the member supporting the pad at a high frequency of about 3200 to about 8500 strokes per minute by a drive system comprising a flexible shaft driven by an electric motor and a cam arrangement driven by the flexible shaft and coupled to the pad supporting member. The amplitude of the vibrator is set between 0.0625 and 0.1875 inch for best results.

10 Claims, 4 Drawing Figures

2
2
10
11
13
14
16
17
18
19
19a
20
21
22
23
45
45
45
50
50
52
53
54
ON
OFF

PERCUSSION VIBRATOR DEVICE FOR TREATMENT OF PATIENTS TO ASSIST EXPECTORATION OF RETAINED SECRETIONS

This invention relates generally to an apparatus which delivers mechanical percussion vibrations and more particularly to a device adapted to deliver mechanical percussion vibrations which can be used in chest physio-therapy.

Chest clapping and vibrations produced by a therapist's hands have been employed to assist cough and expulsion of retained secretions in patients undergoing treatment for obstructive pulmonary disorders. The therapist delivers a series of rapid but gentle blows with the open hand to the chest cage over the area of the lung which contains air passages which are obstructed with mucous secretions. The technique has been used for patients with cystic fibrosis and has become recognized as an aid in combating bronchial obstructions. The effectiveness of the chest clapping, however, depends largely upon the skill and patience of the therapist.

It has been proposed heretofore to use a vibrator of the type commonly used for muscle massage in chest therapy. An apparatus of this general type was used, for example, in experimental work described in an article entitled "Bronchial Secretions In Cystic Fibrosis" by Robert Denton, one of the applicants, in the American Review Of Respiratory Diseases, Vol. 86, No. 1, July 1962. The initial clinical trials with the device described in the article were not entirely successful because the low amplitude mechanical hammer which delivered frequencies of vibrations of 25 to 30 excursions per minute did not produce uniform results in patients of various size and age groups. Hence, while the initial clinical tests reported in the article demonstrated that treatment with a low amplitude mechanical hammer will assist the expulsive power of cough in the pediatric patient with cystic fibrosis, the results of the earlier tests indicated that the mechanical device was no more effective than clapping of the chest with the therapist's hands particularly in the treatment of adult patients.

It is, therefore, an object of this invention to provide an improved mechanical percussion vibrator adapted to be used in chest physio-therapy. Another object of the invention is to provide a mechanical percussion vibrator which can be adapted for the treatment of obstructive pulmonary disorders in patients of various ages and size. Still another object of the invention is to provide an apparatus adapted to deliver mechanical percussion vibration in a constant and high level of energy transfer capable of penetrating the variable thickness of the chest wall and deliver vibrations to the lung. Still another object of the invention is to provide an improved apparatus in a compact mobile unit for delivering mechanical percussion vibrations to be used in chest-physio therapy which is easily modified for treatment of a patient of substantially any age or physical condition.

Other objects will become apparent from the following description with reference to the accompanying drawing wherein FIG. 1 is a side elevation of one embodiment of the invention;

Figure 1:
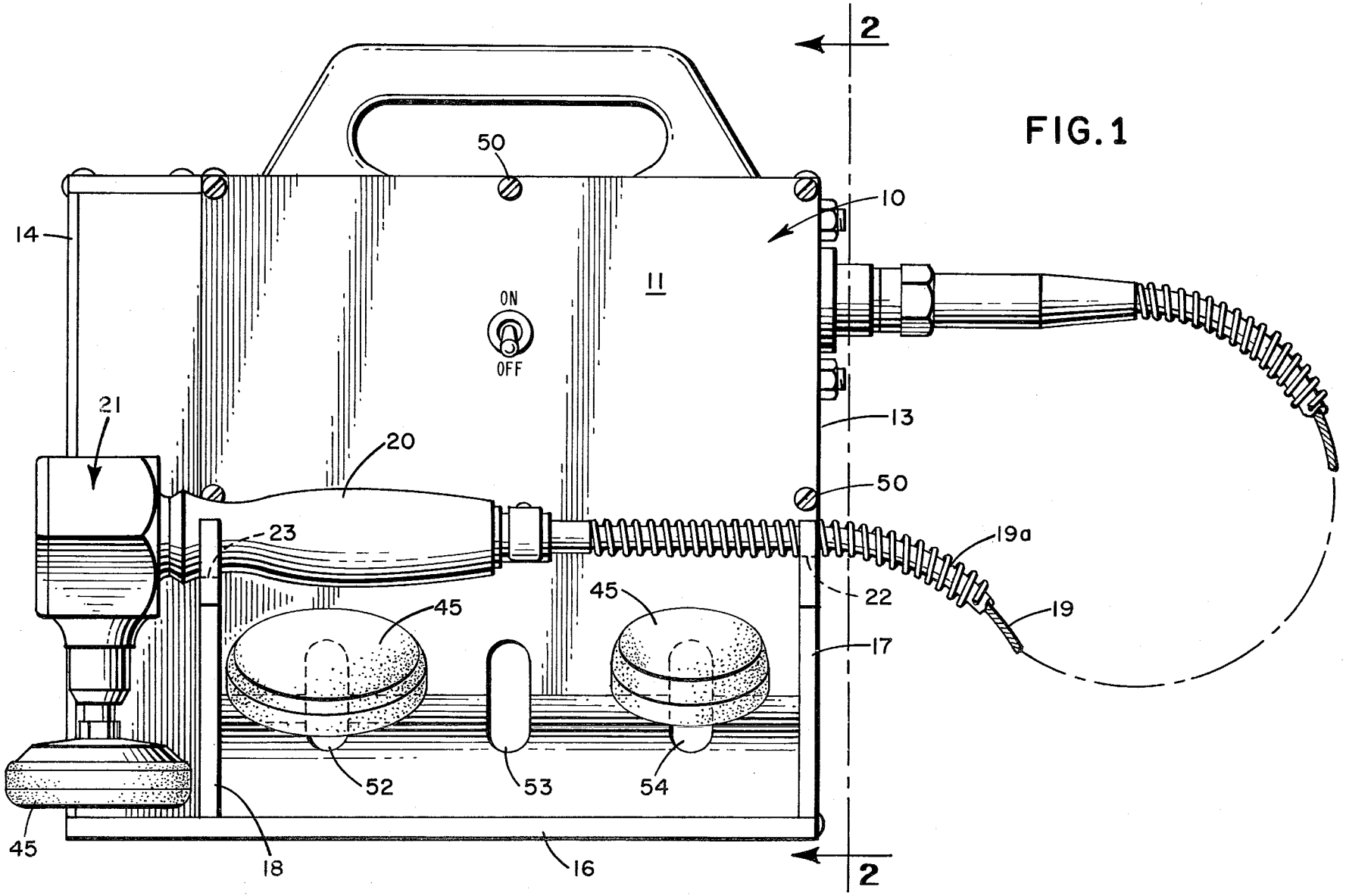

The foregoing objects and others are accomplished in accordance with this invention, generally speaking, by providing an apparatus for delivering percussion vibrations provided with a foam rubber or similarly resilient rubber or synthetic resinous pad fixed on the end of a reciprocating shaft and designed to strike the chest of a patient suffering from an obstructive pulmonary disorder without injury to the chest wall at a high frequency and at an amplitude which effectively assists expulsion of mucous secretions retained in the lung. The percussion vibrating unit is driven by a drive mechanism in which the reciprocating shaft which supports the resilient pad is coupled eccentrically to a rotatable disc mounted coaxially on a rigid shaft which in turn is driven by a flexible shaft. An electric motor safely enclosed in a suitable housing is operably connected to the flexible shaft by a pulley wheel and timing belt assembly which imparts rotary motion to the flexible shaft at from about 3200 to 8500 RPM, preferably at about 6900 RPM. The reciprocating shaft is coupled to the rotatable disc at a position offset from center to provide a stroke having an amplitude of about 0.0625 to 0.1875 inch. It has been found that the amplitude and the frequency of the reciprocating shaft should be varied depending upon the size and age of the patient within the stated ranges to provide treatment of obstructive pulmonary disorders which is more uniformly effective than treatment by the earlier experimental device or hand clapping.

The electric motor is suitably mounted in a housing which completely encloses it and has a handle on top to be grasped by the hand for carrying the apparatus. Brackets are provided on opposite ends of the housing which extend outwardly therefrom and have a semi-circular groove in the top thereof for supporting the flexible shaft and its vibrator unit externally along one side of the housing. A series of longitudinally spaced slots each adapted to receive the shaft of a vibrator pad is provided in the housing between the brackets for storage of extra pads.

The dimensions and firmness of the pad are varied depending upon the size of the patient and the condition of his chest. The following set of pads has been found to be advantageous for use on various sized and aged patients:

TABLE I

| PAD | DIA-METER | THICK-NESS | SIZE PATIENT | BUILD PATIENT |
|---|---|---|---|---|
| Pad A | 2.3 inches | 0.20 inches | Adult | Heavy padded chest of fat & muscle |
| Pad B | 2.3 inches | 0.65 inches | Large Adult | Obese chest without heavy muscles |
| Pad C | 2.0 inches | 0.40 inches | Average Adult | (most common pad used) |
| Pad D | 1.8 inches | 0.50 inches | Young Adult to Teenager | Thin chest wall |
| Pad E | 1.5 inches | 0.30 inches | Toddler to Teenager | |
| Pad F | 1.2 inches | 0.30 inches | Newborn to Toddler | |

The pad is preferably a foam rubber or a porous synthetic resin pad mounted on a rigid rubber or plastic backing member. A threaded member such as a bolt has a head on one end embedded in the rigid backing member and a threaded shaft. The firmness of the pad should also be varied with the patient with the firmer pad being used for the adult having a chest heavily padded with fat and muscle and the softest pad being used for the newborn or toddler. Best results have been obtained so far if the pad has a 25% compression deflection between about 5 pounds per square inch and 12 psi and a 60% compression deflection of between about 40 psi and 80 psi determined in accordance with the procedure of ASTM D1056. The firmer pad, i.e. the one having the higher compression deflection curves is used for the larger patients having a muscular chest and the softer one is used on the younger and frailer patients.

Referring now to the drawing, the embodiment of the apparatus illustrated in FIGS. 1 through 4 has a housing 10 with sidewalls 11 and 12 and end walls 13 and 14. A supporting wall 14*a* is disposed intermediate walls 13 and 14 and the sidewall may be recessed to provide space for accommodating the vibrating unit (to be described later) while it is disposed in the position illustrated in FIG. 1. The housing 10 also has top wall 15 and bottom wall 16. The various walls of the housing 10 are joined together by appropriately placed screws 50. Brackets 17 and 18 are integral with walls 13 and 14*a*, respectively, and extend outwardly from the sidewalls of the housing to provide a support for a conventional flexible shaft 19 and a handle 20 of the vibrating unit 21 alongside wall 11. A semi-circular notch 22 is provided in the top of bracket 17 and a similar notch 23 is provided in bracket member 18.

In the illustrated embodiment a constant speed $\frac{1}{3}$ horsepower motor 24 is mounted by bolts 25 and 26 in housing 10 on bottom wall member 16.

Figure 3:
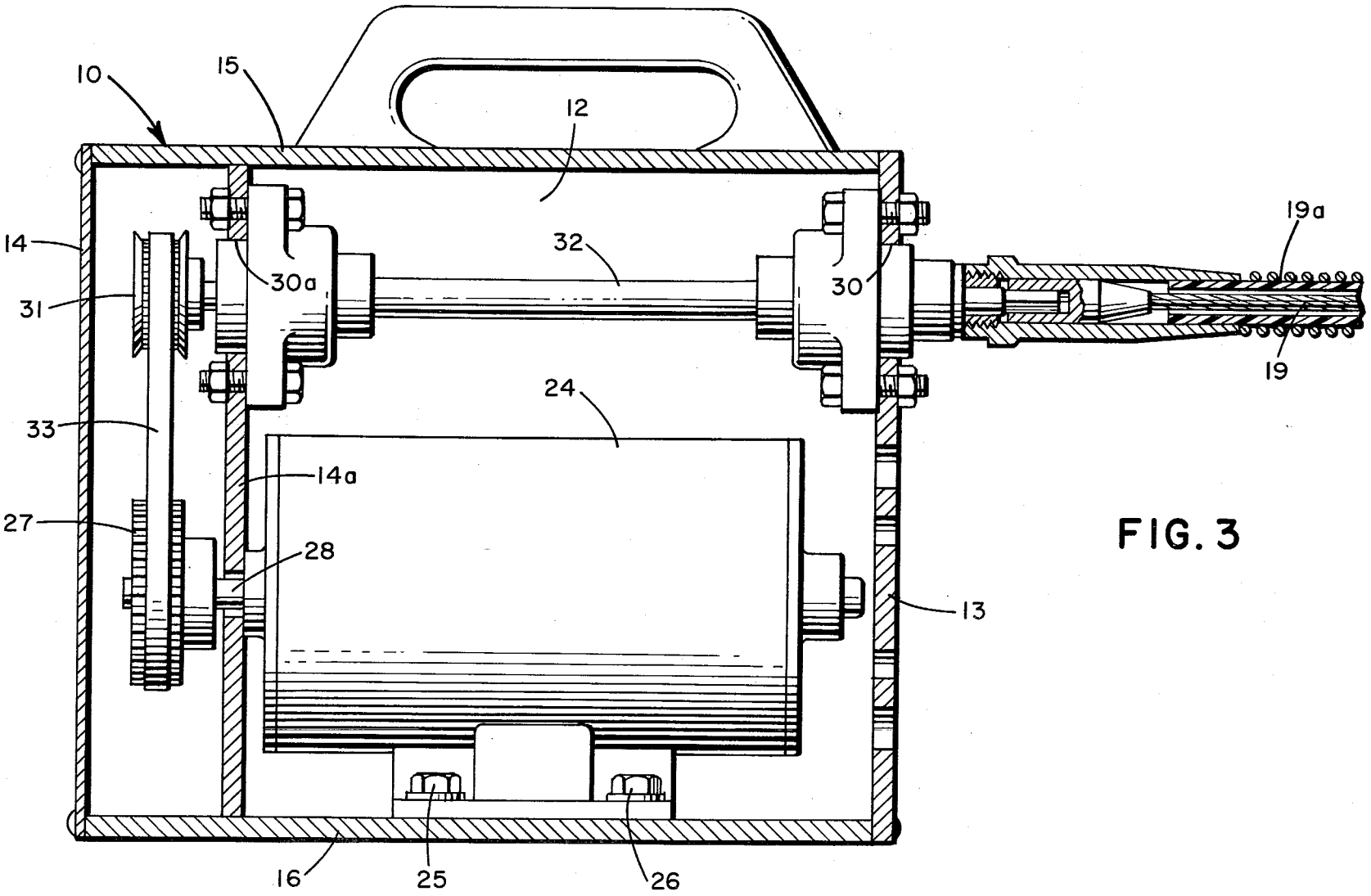
FIG. 3 is a longitudinal section of the drive unit and housing of the embodiment of the apparatus illustrated in FIG. 1.

As shown in FIG. 3, a pulley wheel 27 is secured to motor drive shaft 28 for rotation therewith. A second pulley wheel 31 is disposed above and aligned with pulley wheel 27. A belt 33 is looped about pulleys 31 and 27 so that pulley 31 rotates with pulley 27. A shaft 32 is journaled in bearings supported in an opening 30*a* through intermediate wall member 14*a*. Shaft 32 extends across the space enclosed by housing 10 drivably connected with the end of the flexible shaft 19 as illustrated in FIG. 3. A flexible housing 19*a* encloses shaft 19. A protective coil of wire is wound about housing 19*a*. The shaft 32 is journaled in bearings supported in an opening 30 in wall member 13. Upon rotation of shaft 32, shaft 19 is rotated.

Figure 4:
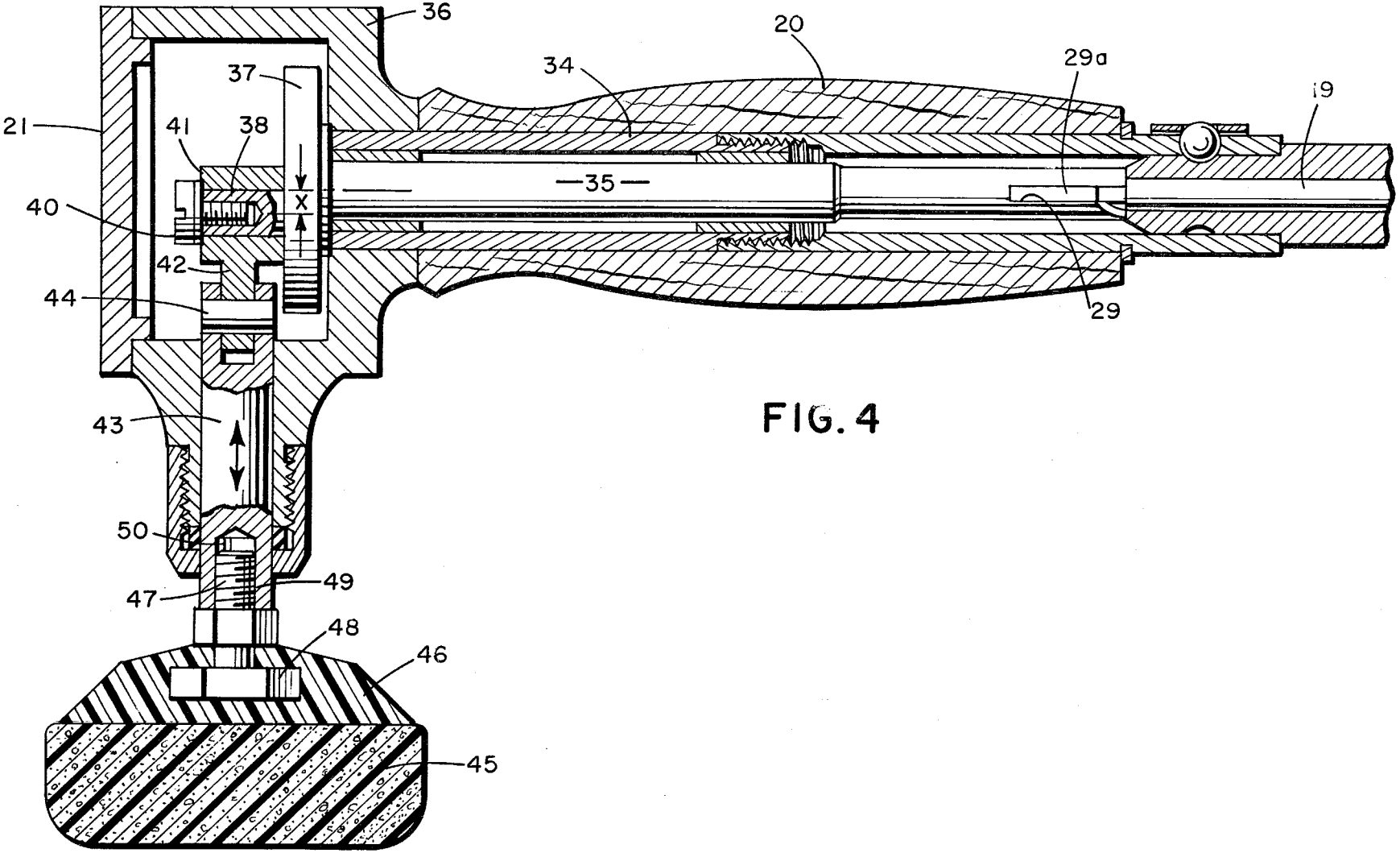
FIG. 4 is an enlarged section of the vibrating unit of the embodiment illustrated in FIG. 1.

As shown in FIG. 4, a sleeve 34 extends partially through handle 20. The end of flexible shaft 19 is operably connected to the end of a rigid shaft 35 by a quick disconnect joint in which member 29*a* is inserted in slot 29. Bearings 55 facilitate separation of flexible shaft 19 from rigid shaft 35. A disc 37 is mounted on shaft 35 for rotation therewith and is enclosed in a housing 36. A stub shaft or pin 38 is secured to disc 37 at a position offset from the axis of the disc and shaft 35.

A foam rubber pad 45 is adhesively bonded to a rigid rubber backing member 46. A bolt 47 has its head 48 embedded in rigid member 46 and has a threaded shaft 49 which is threadably mounted within a bore 50 of a reciprocating shaft 43. The pad 45 has the dimensions of pad A described hereinbefore.

A coupling member has a sleeve 41 disposed on stub shaft 38 and an arm 42 depending from sleeve 41. A screw 40 is threadably secured to the end of shaft 38 and holds sleeve 41 on shaft 38 against longitudinal movement but permits rotary movement with respect to shaft 38. The end of arm 42 is secured by pin 44 to the reciprocating shaft 43. A suitable housing 36 having an opening in which shaft 43 slides encloses the disc 37 and parts of the coupling.

Figure 2:
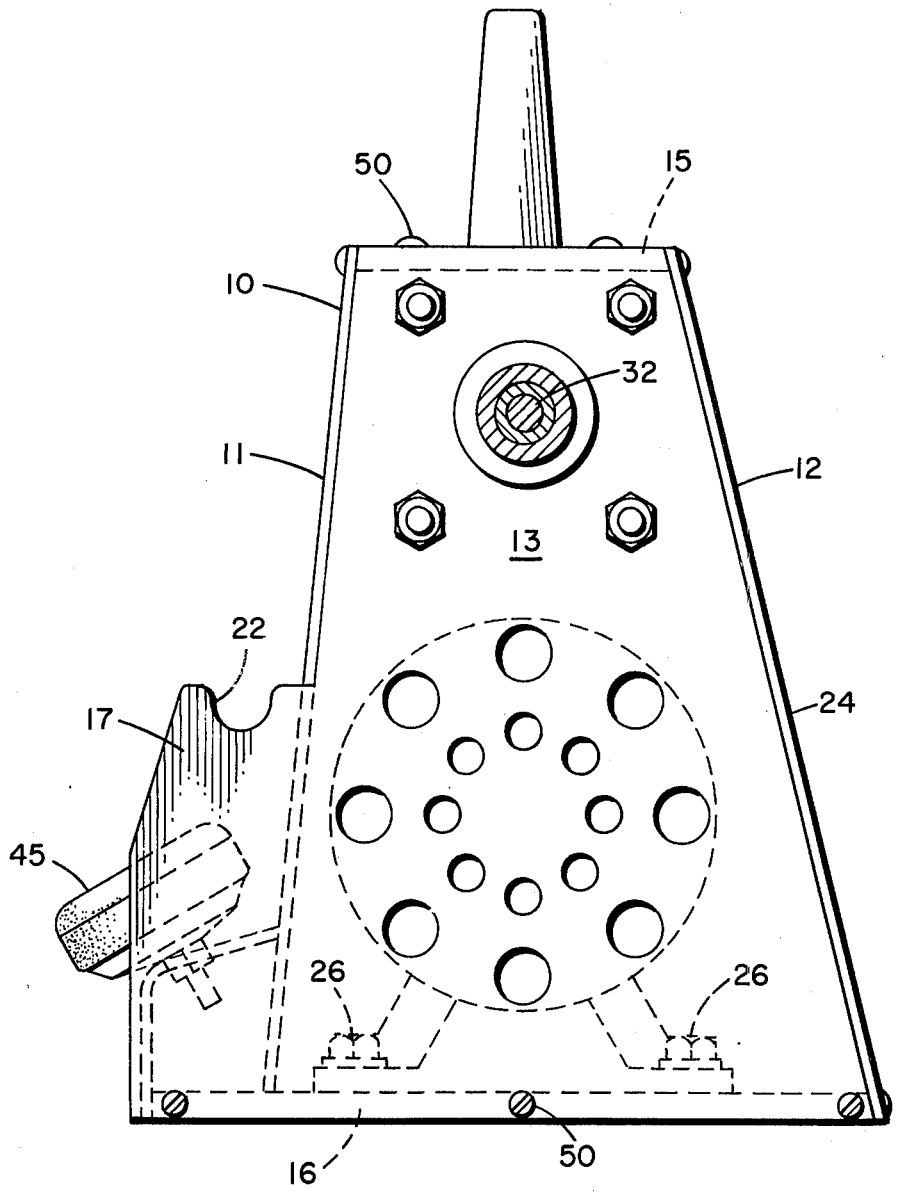
FIG. 2 is an end view, partially in section, taken along the line 2-2 of FIG. 1.

As shown in FIGS. 1 and 2, slots 52, 53 and 54 are provided in wall member 11 between brackets 17 and 18 for storage of extra pads 45.

It should be noted from FIGS. 1, 2 and 4 that the contacting surface of pad 45 is provided with a radius around the contacting edge. In other words, sharp corners are avoided by rounding off the edge formed by juncture of the sidewalls of the pad with its bottom contacting surface.

In operation the vibrator unit 21 is supported in the hand of the operator by handle 20. Motor 24 is started by manually actuating switch 45 which connects the motor to a source of electricity. Shaft 28, pulley wheel 27, belt 33, pulley wheel 31, shafts 32 and 19 are all rotated. This causes rotation of shaft 35 and disc 37 which is coaxially disposed on the end of shaft 35. Eccentrically mounted shaft 38 is rotated eccentrically about the axis of disc 37 and shaft 35. Sleeve 41 and arm 42 follow the eccentric movement of shaft 38 and cause a reciprocating motion of shaft 43. This in turn moves pad 45 up and down at a speed which imparts a percussion vibrating motion. The therapist presses pad 45 against those portions of the chest cavity which overlap the lungs. Fluids within the lung passageways are loosened by this rapid impact and the patient will cough and expel the fluid from the lungs.

The invention broadly contemplates operation at a frequency of between 3200 to 8500 excursions per minute depending upon the thickness of the chest wall and other conditions of the patient but most often the frequency will be between about 4800 and about 8500 excursions per minute. Either a constant speed motor or Variac drive unit may be used. The firmness and dimensions of the resilient pad and the stroke of the shaft which supports the pad are also selected depending upon the condition of the patient and are coordinated with the frequency and amplitude to be used so that the vibrations will effectively penetrate the chest wall and dislodge fluids held in the lung passages. The apparatus of the invention can be firmly pressed against the chest wall without injury to the patient and without appreciable reduction in frequency or stalling of the vibrator.

When it is desired to change the amplitude of the vibrator unit, it is most convenient to substitute a new vibrator head for the one being used. To do this the flexible shaft 19 and shaft 35 are separated at the quick disconnect joint 29,29*a* and a new head having a disc 37 with a different off-set is operably connected to the flexible shaft. Hence, it is advantageous to supply a mobile unit having a plurality of percussion units so that it is not necessary to disassemble the percussion vibrator unit to change disc 37 from one patient to the other.

Although the invention is described in detail for the purpose of illustration, it is to be understood that such detail is solely for that purpose and that variations can be made therein by those skilled in the art without departing from the spirit and scope of the invention except as it may be limited by the claims.

What is claimed is:

1. A mobile apparatus adapted for treatment of a patient to assist in expectoration of retained secretions in the lungs comprising a housing enclosing a space, a drive means enclosed in said space by said housing, a percussion vibrator unit comprising a pad adapted to strike the chest of a patient at a frequency of about 3200 to about 8500 times per minute without injury to the chest, said pad having a 25% compression deflection of from about 5 psi to about 12 psi and a rigid supporting backing member secured thereto, and a reciprocating shaft secured to said pad assembly for transferring percussion vibratory motion to the assembly, and means for imparting reciprocating motion to the said reciprocating shaft at a frequency of about 3200 to 8500 strokes per minute comprising a flexible shaft and means for drivably connecting the flexible shaft to the drive means and including an eccentrically-disposed element between the drive means and the reciprocating shaft, said housing having spaced brackets for suporting said flexible shaft and vibrating unit externally of the housing.

2. A method for treating patients to assist in expectoration of retained secretions in the lungs comprising contacting the patient's body in the region about the lungs with the pad of a percussion vibrator delivering from about 3200 to about 8500 strokes per minute, said pad having a 25% compression deflection of from about 5 psi to about 12 psi and 60% deflection of from about 40 psi to about 80 psi.

3. The method of claim 2 wherein the amplitude is from about 0.0625 to about 0.1875.

4. A percussion vibrating apparatus for the treatment of a patient to assist in expectoration of retained secretions in the lungs comprising a percussion vibrator unit having a reciprocating member comprising a resilient pad adapted to strike a patient's chest without injury thereto at a high frequency, said vibrator unit comprising a rigid shaft, a disc secured coaxially to one end of the shaft, a stub shaft secured to the opposite side of the disc at a position offset from the axis of the disc for eccentric rotation therewith, a reciprocating shaft, and means for coupling the reciprocating shaft to the eccentrically disposed shaft for imparting a reciprocating motion thereto with rotation of said disc, means for driving the vibrator unit at a frequency of from about 3200 to about 8500 excursions per minute at an amplitude of from about 0.0625 inch to about 0.1875 comprising a motor, a flexible shaft and a pulley and timing belt assembly drivably connecting the motor to the flexible shaft, and a housing enclosing the motor and said pulley and belt assembly, and a second housing enclosing the movable parts of the vibrator unit.

5. The apparatus of claim 4 wherein the rigid shaft and flexible shaft are connected by a quick disconnect assembly.

6. A percussion vibrating apparatus for the treatment of a patient to assist in expectoration of retained secretions in the lungs comprising a percussion vibrator unit having a reciprocating member comprising a resilient pad adapted to strike a patient's chest without injury thereto at a high frequency, said vibrator unit comprising a rigid shaft, a disc secured coaxially to one end of the shaft, a stub shaft secured to the opposite side of the disc at a position offset from the axis of the disc for eccentric rotation therewith, a reciprocating shaft, and means for coupling the reciprocating shaft to the eccentrically disposed shaft for imparting a reciprocating motion thereto with rotation of said disc, and means for driving the vibrator unit at a frequency of from about 3200 to about 8500 excursions per minute at an amplitude of from about 0.0625 inch to about 0.1875 comprising a motor, a flexible shaft and a pulley and timing belt assembly drivably connecting the motor to the flexible shaft.

7. A percussion vibrating apparatus for the treatment of a patient to assist in expectoration of retained secretions in the lungs comprising a resilient pad adapted to strike a patient's chest without injury thereto at a high frequency, and means comprising a motor, flexible shaft and a pulley and timing belt assembly drivably connecting the motor to the flexible shaft for driving the vibrator unit at a frequency of from about 3200 to about 8500 excursions per minute at an amplitude of from about 0.0625 inch to about 0.1875 inch, and including an eccentricallydisposed element between the driving means and the resilient pad.

8. The apparatus of claim 7 wherein the peripheral edge joining the striking surface with the sides of the pad is rounded off.

9. The apparatus of claim 12 wherein the means for rotating the disc comprises a pulley and timing belt assembly drivably connecting the motor to the flexible shaft.

10. The apparatus of claim 7 wherein the said pad has a foam rubber member which strikes the patient, the 25% compression deflection of the said member being from about 5 psi to about 12 psi and 60% compression deflection being from about 40 psi to about 80 psi.

* * * * *